US012092440B2

(12) United States Patent
Palmer

(10) Patent No.: US 12,092,440 B2
(45) Date of Patent: Sep. 17, 2024

(54) EXTERIOR VEHICLE-ATTACHED DEVICE REMOVAL

(71) Applicant: Battelle Memorial Institute, Columbus, OH (US)

(72) Inventor: Katherine M. Palmer, Columbus, OH (US)

(73) Assignee: Battelle Memorial Institute, Columbus, OH (US)

( * ) Notice: Subject to any disclaimer, the term of this patent is extended or adjusted under 35 U.S.C. 154(b) by 0 days.

(21) Appl. No.: 17/483,775

(22) Filed: Sep. 23, 2021

(65) Prior Publication Data

US 2022/0090895 A1 Mar. 24, 2022

Related U.S. Application Data

(60) Provisional application No. 63/082,440, filed on Sep. 23, 2020.

(51) Int. Cl.
*F42B 33/06* (2006.01)
*F41H 11/00* (2006.01)

(52) U.S. Cl.
CPC ..... *F42B 33/06* (2013.01); *F41H 11/00* (2013.01)

(58) Field of Classification Search
CPC ..... F42B 33/06; F41H 11/00; F41H 11/12
USPC ..... 89/1.13; 86/50; 102/402, 403
See application file for complete search history.

(56) References Cited

U.S. PATENT DOCUMENTS

| | | | | |
|---|---|---|---|---|
| 7,132,625 | B2 | 11/2006 | Voeltzel | |
| 7,706,647 | B2 | 4/2010 | Sandhu et al. | |
| 9,198,232 | B2 | 11/2015 | Lashmore et al. | |
| 9,775,196 | B2 | 9/2017 | Song et al. | |
| 10,264,627 | B2 | 4/2019 | Hartzler et al. | |
| 10,267,600 | B1 * | 4/2019 | Hower | F41H 5/007 |
| 10,474,144 | B2 * | 11/2019 | Wieneke | G05D 1/0044 |
| 10,900,755 | B1 * | 1/2021 | Paranto | F41H 13/0043 |
| 10,935,349 | B1 * | 3/2021 | Hower | F41H 5/007 |
| 11,221,196 | B2 * | 1/2022 | Babu | F41H 11/136 |
| 2008/0136626 | A1 * | 6/2008 | Hudson | G05D 1/0248 348/148 |
| 2012/0185115 | A1 * | 7/2012 | Dean | F41H 7/005 701/2 |
| 2014/0339210 | A1 | 11/2014 | Kobayashi et al. | |
| 2020/0107408 | A1 | 4/2020 | Torrico et al. | |

FOREIGN PATENT DOCUMENTS

| | | | |
|---|---|---|---|
| JP | S62154493 | A | 7/1987 |
| WO | 2013081180 | A1 | 6/2013 |

OTHER PUBLICATIONS

Chu et al., "Self-heating fiber reinforced polymer composite using meso/macropore carbon nanotube paper and its application in deicing", Carbon 66 (2014), 154-163, Elsevier Ltd.

(Continued)

*Primary Examiner* — Michael D David
(74) *Attorney, Agent, or Firm* — Susanne A. Wilson; Frank Rosenberg

(57) ABSTRACT

Various methods and devices have been invented to remove IEDs and tracking devices from substrates such as the body of vehicles. For example, highly localized heat can be used to denature strong magnets or weaken applied adhesives.

19 Claims, 4 Drawing Sheets

(56) References Cited

OTHER PUBLICATIONS

Tarfaoui et al., "Self-heating and deicing epoxylglass fiber based carbon nanotubes buckypaper composite", Journal of Materials Science, (2019), vol. 54, Issue 2, pp. 1351-1362, Springer.
Machine translation of description of Japanese Patent No. JP S62154493 A.
Written Opinion Of The International Preliminary Examining Authority from international application No. PCT/US2020/052334 mailed Sep. 15, 2021.
International Search Report and Written Opinion for International Application No. PCT/US2020/052334, mailed Dec. 11, 2020.

* cited by examiner

EXTERIOR VEHICLE-ATTACHED DEVICE REMOVAL

RELATED APPLICATION

This application claims the priority benefit of U.S. Provisional Patent Application Ser. No. 63/082,440 filed 23 Sep. 2020.

INTRODUCTION

There is a need for effective and simple methods of targeted removal/destruction of IEDs or tracking devices in field applications. The current approach to removal of IEDs or tracking devices from vehicles requires crowbars and significant brute mechanical force to overcome the magnets used for attachment.

One alternative to pure mechanical removal methods is to use electrothermally generated localized heat sources, pressure generation, chemical solvation, or a combination thereof. Increasing the temperature of the surface around the IEDs can partially or completely demagnetize the attachment magnets for easier removal, while a compact pressure generation source, potentially along with partial or complete solvation of a chemical adhesive bonding the IED or tracking device to the vehicle, could then assist with the removal.

SUMMARY OF THE INVENTION

Small flexible HeatCoat™ spot heaters developed by Battelle provide durable, low mass heaters able to reach tight spots with exceptional performance even at low power. For example, they have been shown to reach over 1600° F. in less than 1 second with only 9 volts applied to the device. The heater can be as small as ¾"×1¼"×1/32" not including the battery. The unique geometry of the heater creates an extremely high power density due to the constriction of the current in a central location. This is especially pronounced at the edges of the constriction as seen in the power density figure (FIG. 4) where the inside corners have the highest power density of up to 80,000 $W/m^2$.

The spot heaters can be applied directly to magnets. The application of high temperatures can act to partially or completely decrease the strength of the magnet, reducing or eliminating its ability to adhere to the vehicle. Rare earth ferromagnets such as Neodymium and Samarian-cobalt have crystalline structures which create very powerful magnetic fields. These magnets have a maximum operating temperature (Curie Temperature, Tc), above which demagnetization starts to occur. The Tc of neodymium and Samarian-cobalt are up to 750° F. and 1400° F. respectively. The application of spot heaters can quickly heat up the metal substrate in a controlled fashion, which will demagnetize the attachment magnet and allow safe removal of the IED or other device.

Spot heaters can also work in cases where an adhesive instead of a magnet is used for attachment. Room temperature cure epoxies, for example, have maximum service temperatures around 250° F. High temperature heat cured adhesives may maintain strength even up to 500° F. before starting to soften. The spot heaters could be used to increase the temperature of the structural adhesive joints enough to debond components without damage to base substrates.

By modifying the geometry and applied current, the temperature and heated area can be tuned accordingly to minimize damage to surrounding areas. The spot heaters are very flexible and can conform around unique shapes and geometries such as inside corners, wheel wells and other tight spaces. They can also be small enough to place directly over small rivets and other fasteners for very precise heat application. The prototypes designed in this effort will be integral in providing the most efficient and effective simple method for removing exterior vehicle-attached devices.

This localized heating technology can also be used in combination with Battelle's ChemEngine technology, which can produce at least 48 psi of pressure per 25 mL of non-hazardous chemical volume in less than 3 seconds. This type of small on demand pressure generation system may also assist in removal of an IED from a vehicle surface, so even a partially demagnetized IED may be removed with less brute force. Adhesive bonds and mechanical fasteners weakened after exposure to high localized heat may be forced apart with pressure generated from ChemEngine devices.

The gas generated in a ChemEngine can be used as a blast of gas or within a balloon that is wedged between the IED and the substrate. Alternatively, ChemEngine technology can be used to project a heated solvent, preferably injected into the adhesive, to dissolve the adhesive between the IED and vehicle.

Concepts include: A method of removing an IED from the body of a vehicle, wherein the IED is bonded to the vehicle by at least one rare earth ferromagnet, comprising:

applying heat from a spot heater to the at least one rare earth ferromagnet; and wherein the heat from the spot heater is sufficient to cause the magnetic strength of the at least one rare earth ferromagnet is reduced by at least 20% or at least 30% or at least 50% or at least 70%.

A method of removing an IED from the body of a vehicle, comprising:

applying heat from a spot heater to an adhesive bond between the IED and the body of a vehicle; wherein the bond is created, at least in part, by an adhesive layer between the IED and the body of the vehicle; and wherein the heat reduces the viscosity of the adhesive and/or decreases adhesion of the adhesive to weaken the adhesive bond between the IED and the body of a vehicle.

The method can be further characterized by one or more of the following features; a heated fluid or expanding gas provided by ChemEngine technology; a spot heater in which electric current passes into a resistive heating material having where heat is concentrated in an area of reduced mass; wherein the resistive heater of the spot heater comprises at least 10, or 20, or 50, or 70 mass % CNTs; and/or any of the ChemEngine and/or spot heater features discussed below.

Alternatively, an IED can be removed from a vehicle by applying a rapidly expanding gas to force apart the IED and the vehicle or a hot fluid to disrupt the bond between the IED and the vehicle.

The invention also includes a device for applying the spot heater to the IED or bond between the IED and vehicle.

GLOSSARY

Figure 1:
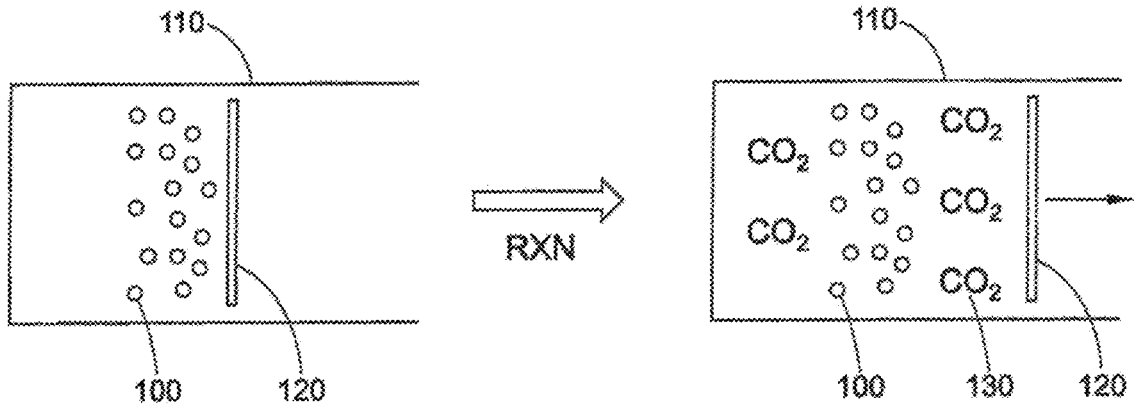
FIG. 1 illustrates the general principle of expansion from a gas generating reaction. Although the figure shows $CO_2$, it should be recognized that the decomposition of $H_2O_2$ forms $H_2O$ and $O_2$.

An "activation switch" is a mechanical or electronic mechanism that initiates the combination of reactants that initiates the decomposition reaction. The device can be operated from a button or switch on the device; alternatively, it can be remotely or autonomously (sensor driven) activated through circuitry.

A "fluid" may be a liquid or gas.

A "fluid dispenser" is a device that, when activated, ejects a fluid through one or more orifices. A "fluid flow system" is any device in which activation causes the movement of fluid in the device; this includes, for example, fluid delivery systems as well as systems in which fluid is propelled through a device. It should be noted that many of the terms used herein are relative terms. For example, the terms "inlet" and "outlet" are relative to a direction of flow, and should not be construed as requiring a particular orientation or location of the structure. Similarly, the terms "upper" and "lower", and "top" and "bottom", are relative to a central point. For example, an upper component is located in one direction from the central point and a lower component would be located in the opposite direction from the central point.

An "IED" stands for an "improvised explosive device". In the present invention, an "IED" includes generally an explosive device.

A "liquid" is a substance that flows under the influence of gravity or a small amount of pressure (up to 5 atm).

A "meltable solid", for purposes of the present invention, is an aqueous solution that melts near 0° C., or a biological, organic (meaning carbon-based), or polymeric composition that transitions between a solid and a liquid.

An "orifice" is any opening; an orifice can have an attached neck or nozzle.

A "plunger" (also called an "expansion plunger") is any component that moves or deforms in response to expanding gas generated in the chemical engine and which can transmit force, either directly or indirectly, to a liquid in a compartment that is either adjacent to or indirectly connected to the chemical engine. For example, the plunger could push against a piston that, in turn, pushes against a liquid in a syringe. The plunger may or may not form a seal on the reaction chamber.

An "initiation plunger" is a moveable part that is used to initiate a reaction, usually by directly or indirectly causing the combination of hydrogen peroxide and catalyst. Preferably, the initiation plunger locks into place to prevent any loss of pressure and thus direct all the generated pressure toward the fluid to be ejected from the fluid chamber.

A "thermally conductive wall" is a wall having a thermal conductivity of at least 0.2 W/(mK) (watt per meter Kelvin) at 25° C. More preferably at least 0.5, more preferably at least 1, more preferably at least 2, and in some embodiments the wall is metallic.

Viscosity can be defined in two ways: "kinematic viscosity" or "absolute viscosity." Kinematic viscosity is a measure of the resistive flow of a fluid under an applied force. The SI unit of kinematic viscosity is mm2/sec, which is 1 centistoke (cSt). Absolute viscosity, sometimes called dynamic or simple viscosity, is the product of kinematic viscosity and fluid density. The SI unit of absolute viscosity is the millipascal-second (mPa-sec) or centipoise (cP), where 1 cP=1 mPa-sec. Unless specified otherwise, the term viscosity always refers to absolute viscosity. Absolute viscosity can be measured by capillary rheometer, cone and plate rheometer, or any other known method.

The processes of the present disclosure can be used with both manual syringes, autoinjectors, or other fluid dispensers and is not limited to cylindrical geometries. The term "syringe" is used interchangeably to refer to manual syringes and autoinjectors of any size or shape. The term "injection device" is used to refer to any device that can be used to inject the fluid into a patient, including for example syringes and patch pumps.

Various aspects of the invention are described using the term "comprising;" however, in narrower embodiments, the invention may alternatively be described using the terms "consisting essentially of" or, more narrowly, "consisting of."

DESCRIPTION OF THE INVENTION

The preferred materials for the spot heater are those that can withstand high power densities in the range of 50,000 to 200,000 W/in$^2$ or 100,000 to 150,000 W/in$^2$, or about 120,000 W/in$^2$ and have low thermal mass to allow for rapid heat-up. Suitable materials include metallic foils and carbon-based materials such as graphite foils, carbon nanotube bucky papers, graphene sheets, and similar materials. However, to avoid excessive heat spreading, which would eliminate the effectiveness of the spot heater, it is preferred that conductive materials have thermal conductivity less than about 50 W/mK and/or sufficiently low mass (e.g. a thin film) and on a thermally insulating substrate. Inks and dispersions of these materials can also be used to print or spray-apply patterns of heaters onto substrates. For reusable heaters, any binding material in the ink must be selected to withstand the temperatures that will be generated or must be removed in a second processing step before use.

Because low thermal mass is a highly desirable property of the resistive heating material, carbon nanotubes are especially desirable materials for spot heaters. The term "carbon nanotube" or "CNT" includes single, double and multiwall carbon nanotubes (SWNT, DWNT and MWNT, respectively) and, unless further specified, also includes bundles and other morphologies. Additionally, the CNTs can be any combination of these materials, rather than a specific type; for example, a CNT composition may include a mixture of single and multiwall CNTs, or it may consist essentially of DWNT and/or MWNT, or it may consist essentially of SWNT, etc. CNTs have an aspect ratio (length to diameter) of at least 50, preferably at least 100, and typically more than 1000.

A CNT network can be prepared as a dispersion of CNTs applied directly to a substrate where the solvents used in the dispersion process are evaporated off leaving a layer of CNTs that coagulate together into a continuous network. The CNT network may be prepared from dispersions and applied by coating methods known in the art, such as, but not limited to, spraying (air assisted airless, airless or air), roll-coating, gravure printing, flexography, brush applied and spin-coating. The thickness of the CNT layer is preferably in the range from 0.005 μm to 100 μm, or in the range of 0.05 μm to 100 μm, or in the range of 0.3 μm to 100 μm.

If present, the thickness of a coating composition over the CNT material is preferably 2 mm or less, more preferably 150 μm or less, preferably 50 μm or less, in some embodiments, a 30 thickness of 250 nm to 50 μm; thicker layers can experience foaming or bubbling during application that leads to pathways for a subsequent topcoat to penetrate and disrupt the conductivity of the CNT layer. Since it is important to reduce heat loss, any adjacent layer should not form a substantial heat sink.

A coating composition can be applied to the CNT network by known methods; for example, bar coating or spraying. Techniques, such as troweling, that disrupt the CNT network should be avoided. After application of a protective coating to the CNT network, the coated substrate can be cured. In the curing operation, the film-forming materials crosslink to leave a mechanically durable and chemically resistant film. A polymer protective coating provides sufficient chemical resistance so as to prevent solvents (including water), or other environmental hazards from subsequently applied coatings or solvents from penetrating the polymer and disrupting the CNT network or changing its conductivity significantly. Application of a coating should result in less than 80% change in resistance, preferably less than 10% change in resistance, and still more preferably less than 5% change in resistance, after curing the coating. Likewise, application of subsequent layers on top of this stack preferably do not increase the resistance by more than 5%, preferably by 3% or less.

The spot heaters can be applied to metals, glass, ceramics, and other hybrid organic-inorganic systems. For any substrate that is in contact with the heater, the material should be selected for the service temperature that will be achieved and any dielectric resistance needed to isolate the heater electrically from other conductive components. Bonding for composites and other laminates can, likewise, utilize adhesives that are appropriate for the target temperatures. Arrays of these designs can be used in applications where fast heat up time is desired.

Figure 3:
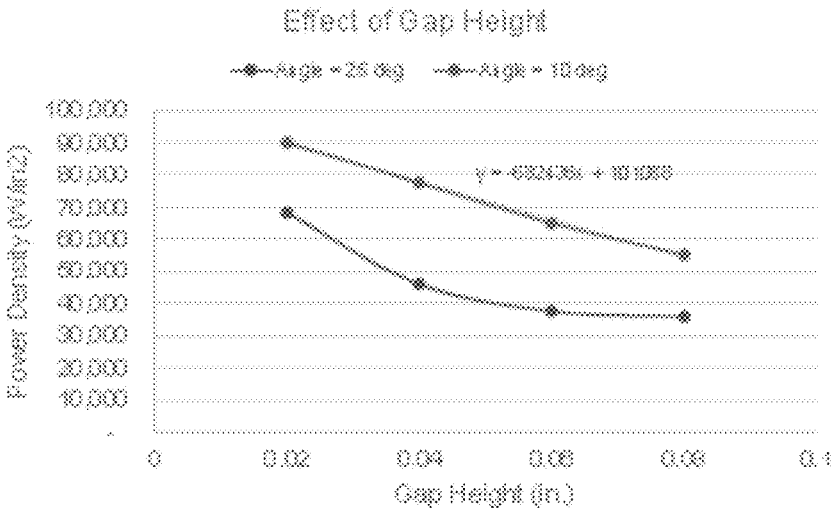
FIG. 3 shows power density as a function of gap height (in inches) for gap angles of 10° (top) and 25° (bottom).
Figure 4:
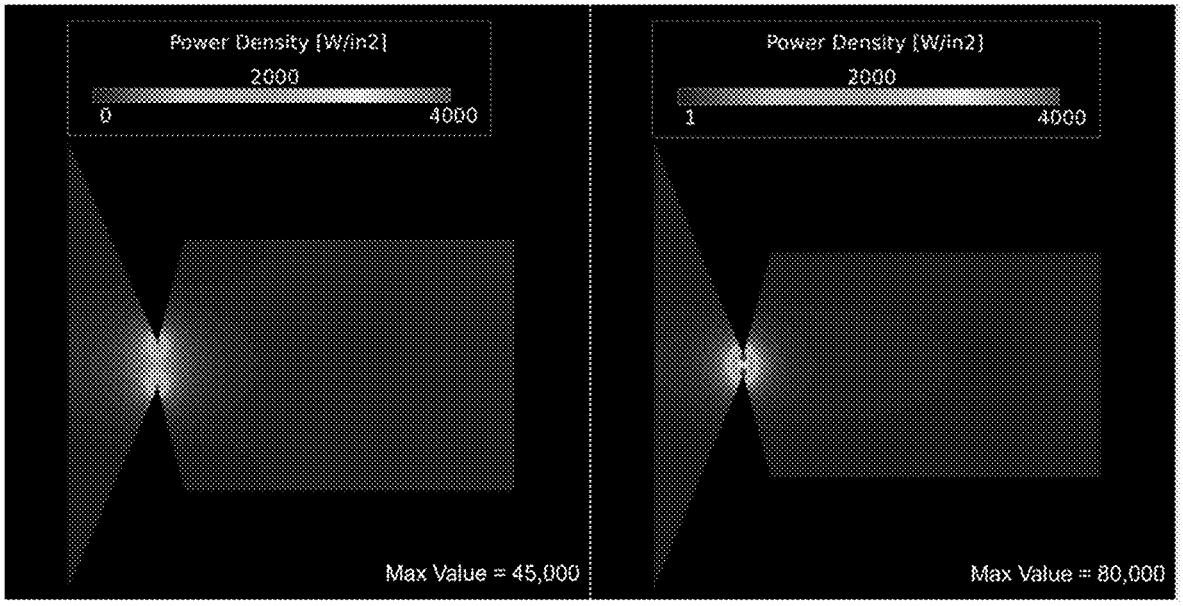
FIG. 4 illustrates how the extent of constriction controls the power density of a hot spot.

Geometries define where hot spots in a spot heater are located. In a preferred feature, a notch is formed in the center of the heater. The notch is used to constrict flow and create a hot spot that is distanced from the heat sink created by the electrode. A notch is preferably created by an angle of at least 70 degrees, or at least 80 degrees, on both sides of the gap; and preferably where the gap is located at least 0.4 cm from any electrode connected to the heater. The width of the notch is the gap height. The size of gap height significantly affects the power density of the hot spot formed by the notch, as shown in FIGS. 3 and 4.

A thermal model has been developed to assess how rapidly one of the optimized heaters would be expected to heat up. For this model, it was assumed that the heater was surrounded by a layer of Kapton tape on either side. When run at 4.5V, the heater is observed to achieve a temperature of approximately 1200° F. in one second. When run at 9.0V, the heater is observed to achieve a temperature of 2000° F. in only 0.25 seconds.

ChemEngine Technology

FIG. 1 illustrates the general principle of expansion from a gas generating reaction. Although the figure shows $CO_2$, it should be recognized that any gas-generating reaction can be used with an electrothermal activation.

Figure 5A:
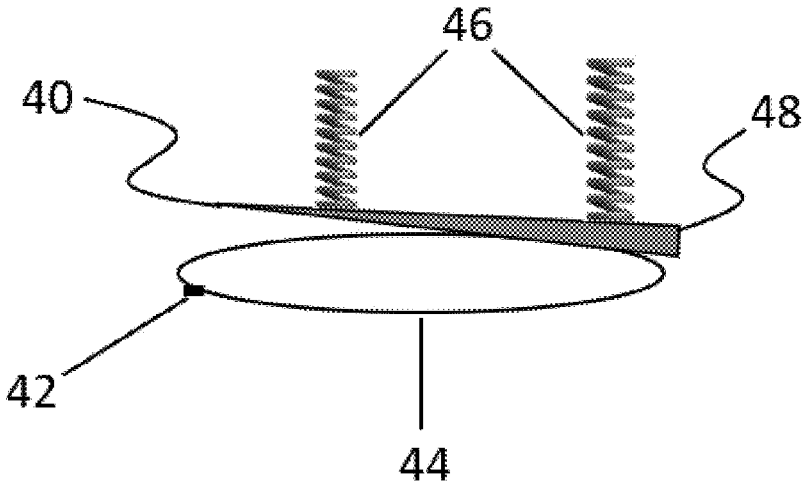
FIGS. 5A and 5B schematically illustrates a pouch-squeezing dispenser in storage and activated modes, respectively.
Figure 5B:
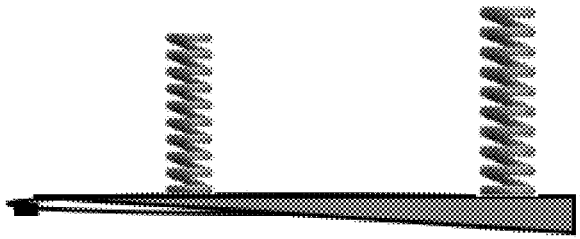

FIGS. 5A and 5B shows the schematics of the storage and activated states of a pouch-squeezing dispenser 40. The pouch 44 is initially sealed with some force being exerted from the dispenser 40 onto the pouch 44. Once the Fluid Output Port 42 is opened (melted), the dispenser pushes the fluid out from the side away from the port 42 toward it, until all fluid has been expelled from the pouch 44. The schematic springs 46 can be springs or they can represent an elastomeric material (e.g., silicone, polyurethane, foam, rubber). An optional push plate 40 can be interposed between the spring mechanism 46 and the pouch 44. The pouch 44 contains a reactant solution and when the fluid output port 42 is opened, the fluid reactant is forced out of the reactant pouch 44 into a reaction chamber where gas is generated to power the fluid delivery.

The springs 46 may be, for example, a "chip clip" which is a spring-loaded clip that pinches the pouch. As an alternative to springs, magnets can apply the force that squeezes fluid from the pouch. In some embodiments, it is desirable that the springs do not deform the reaction chamber (pouch 44).

In one aspect, the invention provides a device for delivering a fluid by decomposition of hydrogen peroxide, comprising: a catalyst chamber (a first chamber) comprising a $H_2O_2$ decomposition catalyst; a hydrogen peroxide chamber (a second chamber) comprising an aqueous solution of hydrogen peroxide; wherein the solids catalyst chamber or the hydrogen peroxide chamber comprises a reaction chamber; a heat-activatable barrier or valve separating the catalyst and the hydrogen peroxide solution; a fluid chamber comprising a fluid or a meltable solid; a thermally conductive wall separating the reaction chamber from the fluid chamber; a plunger (as defined in the Glossary) that moves in response to pressure generated in the reaction chamber such that the volume of the reaction chamber increases and the volume of the fluid chamber decreases; wherein the fluid chamber comprises an orifice such that fluid forced out of the fluid chamber can pass through the orifice. Note that there may be several orifices connected to the fluid chamber but in preferred embodiments there is a single orifice. The device may contain multiple fluid chambers, preferably with one orifice connected to each; the fluid(s) in plural fluid chambers can be forced out by hydrogen peroxide decomposition in a single reaction chamber; or the device may comprise plural reaction chambers, each connected to a single or to plural fluid chambers. In some embodiments, only a portion of the wall that separates the reaction chamber from the fluid chamber is thermally conductive. In some preferred embodiments, the relative amounts of $H_2O_2$ and fluid are sized such that the decomposition of the $H_2O_2$, assuming that 100% of the heat of reaction is consumed in heating the $H_2O_2$ product solution and heating the substance in the fluid chamber and assuming that the substance in the fluid chamber starts at 5° C., will raise the temperature of the substance in the fluid chamber by at least 5° C., or at least 10° C., or in the range of 5 to 40° C., or 10 to 30° C. In many embodiments, the orifice is connected to a nozzle and the fluid passes through the nozzle and then through a needle that is connected to the nozzle. In an alternate embodiment, the device is configured with only a thermally conductive wall separating the reaction chamber from the nozzle—in this case heat from the reaction is focused on fluid in the nozzle. In some embodiments, the orifice connects to a nozzle having a length of at least 0.5 cm and wherein the reaction chamber is disposed around the nozzle and the thermally conductive wall is disposed around the nozzle.

In some preferred embodiments, the wall separating the reaction chamber from the fluid chamber has a higher thermal conductivity than another reaction chamber wall or portion of reaction chamber wall that does not separate the reaction chamber from the fluid chamber. In some embodiments, the ratio of the surface area of the wall separating the reaction chamber from the fluid chamber (only the portion of the wall that is in direct contact with the fluid chamber) to the volume of the fluid chamber is from 0.1 to 10, or 0.5 to 5, or 1.0 to 3 cm2/cc. In some embodiments, except for the thermally conductive wall, the walls of the reaction chamber (and optionally the walls of the fluid chamber) comprise materials (typically a single material) that have a low heat capacity of 0.5 or less or 0.4 or less, or 0.3 or less cal/g ° C. (measured at standard temperature and pressure) and/or a thermal conductivity that is at least 10% less than the conductivity of the thermally conductive wall (or at least 50% less) at 25° C. Typically, these walls are made of a polymer.

The invention also includes systems comprising any of the devices described herein. Preferably, the substance in the fluid chamber is at a temperature of 0 to 80° C. Any of the devices or systems may further comprise a time-delay release on the fluid chamber. One way that a time delay can be implemented is installation of a pressure release feature between the reaction chamber and the fluid chamber. The reaction will be initiated, it will evolve heat, and the pressure will increase until a specified release feature (burst disc, relief valve, viscous grease in capillary) allows the pressure to pass from the reaction chamber to the fluid chamber plunger. In a different embodiment, the plunger could be anchored in place by mechanical means. Once a specified pressure is reached in the reaction chamber, it applies sufficient force to break the mechanical linkage and allows the plunger to move freely. In some preferred embodiments, the time delay release is a valve or frangible barrier disposed at the orifice.

In another aspect, the invention provides a method of delivering a fluid, comprising: providing a device comprising: a reaction chamber and a fluid chamber; wherein the fluid chamber comprises a fluid or a meltable solid; a thermally conductive wall separating the reaction chamber from the fluid chamber; a plunger that moves in response to pressure generated in the reaction chamber such that the volume of the reaction chamber increases and the volume of the fluid chamber decreases; wherein the fluid chamber comprises an orifice such that fluid forced out of the fluid chamber can pass through the orifice; in the reaction chamber, combining hydrogen peroxide with a $H_2O_2$ decomposition catalyst wherein oxygen gas and heat are generated (or combining liquid reactants (or combining a liquid reactant with a solid reactant) that exothermically react to generate a gas); wherein heat from the reaction chamber is transferred to the fluid or meltable solid in the fluid chamber; wherein the oxygen gas produced in the reaction chamber increases pressure inside the reaction chamber and moves the plunger which in turn forces fluid from the fluid chamber. In some preferred embodiments, at least 10%, or at least 20%, or at least 30%, or at least 40%, or at least 50%, or at least 60%, or from 20 to 80% of the heat generated in the reaction chamber is transferred to the substance in the fluid chamber. In some embodiments, the fluid or meltable solid in the fluid chamber is in the range of 0 to 10° C. at the start of the method, and is at a temperature of between 15 and 40° C. or 15 to 35° C. as it exits from the orifice or nozzle. In some embodiments, the fluid chamber comprises a solid that melts or a viscous fluid that changes to a less viscous fluid as a result of heat released from the reaction chamber, wherein the melted solid or less viscous fluid passes through the orifice and out of the device, and then cools and changes to a solid or a fluid with a higher viscosity than the fluid that passes through the orifice. The fluid chamber may comprise a fluid that absorbs heat from the reaction chamber and, as a result, decreases in viscosity. In some preferred embodiments, the fluid decreases in viscosity by at least 10%, 20%, 30%, or at least 50%, or from 10 to 60%.

A device for delivering a fluid by decomposition of hydrogen peroxide, comprising: a barrel containing a reaction chamber and a fluid chamber which are separated by a moveable piston; wherein, prior to use, the reaction chamber comprises separate chambers for catalyst and hydrogen peroxide, and the fluid chamber comprises a fluid; a thermally conductive element that is adapted to transfer heat from the reaction chamber to the fluid. The thermally conductive element could be a metalized foil layer on the reactant pouch, a highly filled polymer resin (for example, Celanese Coolpoly has thermal conductivity up to 40 W/mK), doped glass, or a metallic part.

The fluid delivery devices may include a piston comprising a push surface at the lower end of the reaction chamber, a stopper at the upper end of the fluid chamber, and a rod connecting the push surface and the stopper. This is typically an injection-type configuration. A piston is one type of plunger. Any of the fluid delivery devices may comprise a power source (typically a battery), wires or other electrical connector, and a resistive heater that opens a pathway such that a reactive solution can flow into a reaction chamber, and a switch that can connect the resistive heater to the power source.

In some embodiments, a chemical engine may comprise a lower chamber defined by a one-way valve, a continuous sidewall, and a piston, the one-way valve and the sidewall being fixed relative to each other such that the volume of the lower chamber changes only through movement of the piston.

In preferred embodiments, an upper chamber, lower chamber, and fluid chamber are cylindrical and are coaxial. The upper chamber, the lower chamber, and the fluid chamber can be separate pieces that are joined together to make the device. A one-way valve can feed a balloon in the lower chamber, the balloon pushing against the volume of the fluid chamber or against a piston.

A reaction chamber may be defined by the one-way valve, a sidewall, and a plunger, the one-way valve and the sidewall being fixed relative to each other such that the volume of the reaction chamber changes only through movement of the plunger.

Also disclosed in various embodiments is a device for dispensing a fluid by chemical reaction, comprising: a reaction chamber having first and second ends; a plunger at a first end of the reaction chamber, the plunger being operative to move within the device in response to a pressure generated in the reaction chamber; and a one-way valve at the second end of the reaction chamber permitting entry into the reaction chamber.

The device may comprise a reagent chamber on an opposite side of a one-way valve. The reagent chamber may contain hydrogen peroxide or may contain one or more hydrogen decomposition catalysts (as throughout the invention, the $H_2O_2$ decomposition is only exemplary and can be any gas generating reaction). The device may further comprise a plunger at an end of the reagent chamber opposite the one-way valve. The plunger may cooperate with the reagent chamber to lock an initiation plunger in place after being depressed.

Also disclosed in various embodiments is a device for delivering a fluid by chemical reaction, comprising: a barrel which is divided into a reagent chamber, a reaction chamber, and a fluid chamber by a one-way valve and a piston (or other type of plunger); and an initiation plunger at one end of the reagent chamber; wherein the one-way valve is located between the reagent chamber and the reaction chamber; and wherein the piston separates the reaction chamber and the fluid chamber, the piston (or other type of plunger) being moveable to change the volume ratio between the reaction chamber and the fluid chamber.

FIG. 1 illustrates the generation of pressure by a chemical reaction for use in powering the transfer of a fluid by from a container. Referring to the left hand side of the figures, one or more chemical reagents 100 are enclosed within a reaction chamber 110. One side of the chamber can move relative to the other sides of the chamber, and acts as a piston 120. The chamber 110 has a first volume prior to the chemical reaction.

A chemical reaction is then initiated within the chamber, as indicated by the "RXN" arrow. A gaseous byproduct 130 is generated at some rate, n(t), where n represents moles of gas produced and t represents time. The pressure is proportional to the amount of gaseous byproduct 130 generated by the chemical reaction. The volume of the chamber 110 remains fixed until the additional force generated by the gas pressure on the piston 120 exceeds that needed to push the fluid in the direction indicated by the arrow. The drawing shows $CO_2$, but in the case of hydrogen peroxide, the driving gases are $O_2$ and $H_2O$. The viscosity of the fluid can be approximated using the Hagen-Poiseuille equation (below). The Hagen-Poiseuille equation can predict the mass flow rate of a fluid based on its viscosity, the size orifice it must traverse, and the pressure evolved by the chemical reaction.

$$Q = \frac{\pi \cdot \Delta p \cdot r^4}{8 \cdot \eta \cdot l}$$

Q: discharge volume flow rate

Δp: pressure differential between the two ends of tube r: internal radius of tube l: length of tube η: fluid viscosity Once the minimum pressure required to move the piston 120 is exceeded, the volume of the reaction chamber 110 begins to increase. The movement of the piston 120 causes delivery of fluid within the container to begin. The pressure in the chamber 110 depends on both the rate of reaction and the rate of volume expansion. Preferably, sufficient gas is generated to account for the volume expansion, while not generating too much excess pressure. This can be accomplished by controlling the amount of $H_2O_2$.

The pressure build-up from the chemical-reaction produced gaseous product 130 can be used to push fluid directly adjacent to the piston 120 through the container (the container is a syringe in preferred embodiments). Pressure build-up may also push fluid in an indirect fashion, e.g., by establishing a mechanical contact between the piston 120 and the fluid, for example by a rod or shaft connecting the piston 120 to a stopper of a prefilled syringe that contains fluid.

Figure 2:
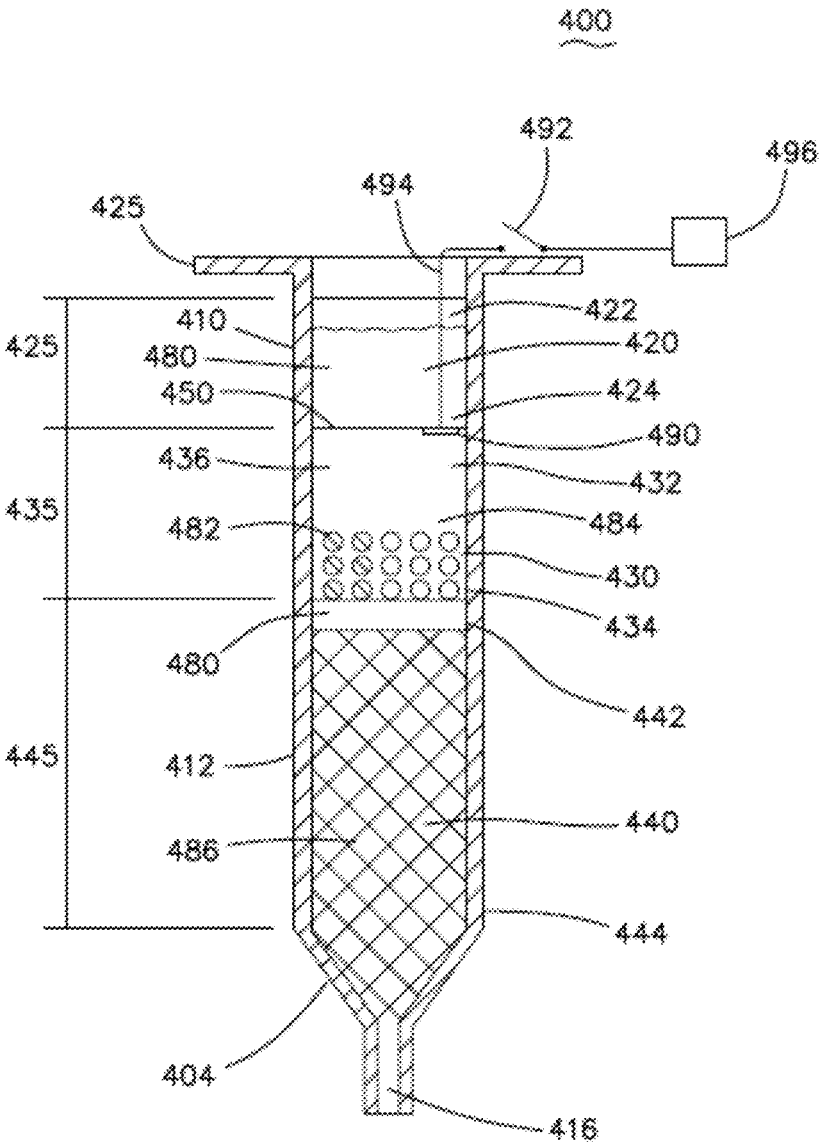
FIG. 2 illustrates one embodiment of an injector.

FIG. 2 illustrates one exemplary embodiment of a device (here, a syringe) that can be used to deliver a high-viscosity fluid using a chemical reaction between reagents to generate a gas. The syringe 400 is depicted here in a storage state in which the chemical reaction has not yet been initiated. The needle is not included in this illustration.

The syringe 400 includes a barrel 410 that is formed from a sidewall 412, and the interior space is divided into three separate chambers. Beginning at the top end 402 of the barrel, the syringe includes a reagent chamber 420, a reaction chamber 430, and a fluid chamber 440. The system is activated by closing switch 492 which forms an electrical conduit from power source 496, through wire 494, and into resistive heating element 490 that heats and activates heat-activatable valve 450. The "valve" could be as simple as a polymeric film that melts to open a pathway between the reagent chamber 420 and reaction chamber 430. The heat-activatable valve 450 is also present at the upper end 432 of the reaction chamber. The heat-activatable valve 450 is directed to permit material to exit the reagent chamber 420 and to enter the reaction chamber 430. The lower end 434 of the reaction chamber is formed by a piston 460. Finally, the piston 460 is present at the upper end 442 of the fluid chamber. The orifice 416 of the barrel is at the lower end 444 of the fluid chamber, and at the bottom end 404 of the syringe. The piston 480 can move within the barrel in response to pressure. After activation, the reaction chamber 430 can be defined by the top wall 425, the barrel sidewall 412, and the piston 480.

The reaction chamber 430 can also be described as having a first end and a second end. In this illustration, the reaction chamber 430 is directly on one side of the piston 480, and the fluid chamber 440 is directly on the opposite side of the piston.

The reagent chamber 420 contains $H_2O_2$ and may optionally contain other materials such as a solvent (water, for example). The reaction chamber 430 contains at least one catalyst. The fluid chamber 440 contains the fluid to be delivered. As depicted here, the reagent chamber 420 contains a solvent 480, the reaction chamber 430 contains two different catalysts 482, 484, preferably in a dry powder form (in other embodiments, there could be only a single type of catalyst or a reactant and a catalyst or multiple reactants with or without a catalyst), and the fluid chamber 440 contains a fluid 486 (in some preferred embodiments, a high-viscosity fluid). Again, it should be noted that this figure is not drawn to scale. The chemical reagents, as illustrated here, do not fill up the entire volume of the reaction chamber. Instead, a head space 436 is present within the reaction chamber.

Each chamber has a volume, which in the depicted illustration is proportional to the height of the chamber. The reagent chamber 420 has a height 425, the reaction chamber 430 has a height 435, and the fluid chamber 440 has a height 445. In this illustrated embodiment, the volume of the reaction chamber is sufficient to contain the solvent and the two chemical reagents; however, in other embodiments, the reaction chamber can be smaller since the volume of the reagent chamber can be used for the reaction.

Activation switch 492 causes the heat activatable valve 450 to be opened, and the liquid 480 enters into the reaction chamber 430 and reacts over and/or dissolves the catalysts. As the amount of gas increases, the pressure exerted on the piston 480 increases until, after reaching a threshold value, the piston 480 moves downward towards the bottom end 404 of the syringe. This causes the volume of the reaction chamber 430 to increase, and the volume of the fluid chamber 440 to decrease. This results in the fluid 486 in the fluid chamber being dispensed through the orifice.

FIG. 2 illustrates one embodiment of a system for delivering a fluid. It should be understood that the gas-powered fluid delivery system and methods of the invention are not limited to this embodiment but can be any design for gas-powered delivery of a fluid, as can be obtained or constructed by the workers skilled in this area without undue experimentation. For example, as mentioned above, the delivery systems may include any of the designs described by Bennison et al. in U.S. Pat. No. 10,046,116.

It is contemplated that a high-viscosity fluid can be dispensed using the propellant compositions of the present disclosure and may be a solution, dispersion, suspension, emulsion, etc. The high-viscosity fluid preferably has an absolute viscosity of from about 5 centipoise to about 100,000 centipoise. In other embodiments, the high-viscosity fluid has an absolute viscosity of at least 40 centipoise, or at least 60 centipoise. The high-viscosity fluid may further contain a solvent or non-solvent, such as water, perfluoroalkane solvent, safflower oil, or benzyl benzoate.

The embodiment of FIG. 2 described above has been illustrated as an autoinjector. Autoinjectors are typically held in the user's hand, have a cylindrical form factor, and have a relatively quick injection time of one second to 30 seconds. It should be noted that the concepts embodied in the above-described figures could also be applied to other types of injection devices, such as patch pumps. Generally, a patch pump has a flatter form factor compared to a syringe. Advantages to using a chemical gas-generating reaction in a patch pump include the small volume required, flexibility in the form/shape, and the ability to control the delivery rate.

It is also contemplated, in alternate embodiments, that a catalyst is attached to the inner side of a plunger (opposite to the side that pushes against the fluid). Thus, when hydrogen peroxide contacts the inner side it decomposes to form gas that forces the plunger to reduce the volume of the fluid chamber.

Suitable materials for the fluid delivery devices of the present disclosure are known in the art, as are methods for making the fluid delivery devices.

The force needed to activate the gas-generating chemical reaction can be far less than that required to activate a spring-driven device or to cock the spring in a spring-driven device. In addition, springs have a linear energy profile. The force provided by the gas-generating chemical reaction can be non-linear and non-logarithmic. The speed of the chemical reaction can be controlled by (i) adjusting the amount or particle size of a dry reagent (solid reagent or solid catalyst); (ii) changing the particle shape of a dry reagent; (iii) adjusting the packing of a dry reagent; (iv) using mixing assist devices; (v) varying the concentration of reactant; and/or (vi) altering the shape of the reaction chamber where the reagents are mixed and/or (vii) changing the concentration of a wet reagent.

In some embodiments, the fluid delivery device contains a resistive heating element that is adapted to form a fluid connection between a reactant chamber and a reaction chamber. An activation switch is turned on to send an electric current through the heating element, generating a hot spot that forms the fluid connection, typically by melting a polymeric barrier between reactant chamber and reaction chamber; for example, the resistive heating element can be attached to a polymeric wall separating a reaction chamber and reactant chamber. In some embodiments, a reactant chamber (for example, filled with an aqueous $H_2O_2$ solution) is a collapsible vessel stored inside a reaction chamber that ejects reactant upon activation. In some preferred embodiments, the reaction chamber contains a fine catalyst powder (such as KI powder)—electrostatics cause the powder to coat all walls of the reaction chamber so that the reaction proceeds rapidly regardless of the orientation of the device.

The hydrogen peroxide may be provided as an aqueous solution, preferably containing at least 10%, or at least 20%, or at least 50%, or from between 10 and 90%, or 10 and 80% $H_2O_2$ by mass. Desirably, neither the hydrogen peroxide chamber nor the catalyst chamber comprises organics such as an organic solvent (for example, no alcohols and no aromatics or other organic liquids).

There are many catalysts that drive hydrogen peroxide decomposition, such as iron(III) chloride solution, manganese dioxide, copper(II) oxide, copper(II) sulfate, zinc oxide, and potassium iodide among others. The metal oxides are preferably present as dry powders. Water soluble catalysts such as potassium iodide, iron (III) chloride, catalase, $FeSO_4.7H_2O$ or $CuSO_4.5H_2O$, benzoic acid derivatives, $Mn(OH)_2$, ammonium hydroxide and iodine, haemase enzyme, metallic salts in quinoline/water, and NaOH can be provided in the catalyst chamber as solutions, and some as solid powders. In the case of powders, the hydrogen peroxide solution should be transferred into the catalyst chamber which then becomes the reaction chamber. In the case of catalyst solutions or suspensions, the catalyst solution can be mixed with the hydrogen peroxide solution.

Preferably, in some embodiments, the invention provides heating of a fluid using the heat of reaction from hydrogen peroxide decomposition. Warming the fluid may provide a variety of advantages. For example, warming a fluid may decrease the viscosity of the fluid and allow for smaller needles or faster delivery time. Where the reaction chamber is adjacent to, or otherwise in thermal contact with the fluid chamber or any part of the fluid flow path (such as a needle), this configuration works to warm the fluid simultaneously as pressure is created.

The reactor and the fluid chambers will have intimate contact and good heat transfer to allow the heating to occur in a useful time scale. The fluid chamber wall is preferably thin, preferably 0.01 inch, or 0.005, or 0.001 inch or less, or from 0.001 to 0.1 inch. The fluid chamber may be designed to enhance heat transfer from the reaction chamber, at least in selected areas in which it is in direct contact with the reaction chamber and may contain a metal, polymer resin composite with a thermally-conductive filler, or other material which has high thermal conductivity. Since the reactor container can be a flexible pouch, it can be shaped around a rigid fluid chamber for maximum contact area. The flexible pouch can be comprised of a thermally conductive foil. In some embodiments, the fluid chamber is a glass drug vial. Preferably, a wall separating the fluid and reaction chambers comprises a substance having a thermal conductivity of at least 1 W/m·K. The fluid chamber may be comprised of two or more materials of varying thermal conductivity, for example, a relatively low thermal conductivity section comprising the plunger for expansion of the reaction chamber and/or compression of the fluid chamber; and a second region of the fluid chamber comprising a relatively high thermal conductivity; for example, a metallic (or other high thermal conductivity material) region that has no or little flexibility under the reaction conditions but provides for heat transfer into the fluid. In some preferred embodiments, the fluid is in direct contact with the surface for high thermal transfer.

In some preferred embodiments, the fluid remains in contact with a surface of the reaction chamber wall (for example, an expandable reaction chamber wall) so that, even after delivery to a surface, the fluid continues to be warmed after application to a surface. In some preferred embodiments, the ratio of (heated) reaction chamber wall to adjacent fluid flow path volume is in the range of 0.1 to 15, or 0.3 to 10, or 0.5 to 3 $cm^2/cc$.

In some preferred embodiments, the flexible reaction chamber pouch can also be disposed around the injection needle or nozzle (or another fluid flow path). This increases the fluid's exposure to a warm surface as the surface area to drug volume increases in small diameter flow channels.

What is claimed:

1. A method of removing an IED from a substrate, wherein the IED is bonded to the substrate by at least one rare earth ferromagnet, comprising:

applying a conductive portion of a spot heater in direct contact with the at least one rare earth ferromagnet;

applying heat from the spot heater to the at least one rare earth ferromagnet;

wherein the heat from the spot heater is sufficient to cause the magnetic strength of the at least one rare earth ferromagnet to be reduced by at least 20%; and removing the IED from the substrate without destroying the IED.

2. A method of removing an IED from a substrate, comprising:

applying heat from a spot heater to an adhesive bond between the IED and the substrate;

wherein a conductive portion of the spot heater is in direct contact with the adhesive;

wherein the bond is created, at least in part, by an adhesive layer between the IED and the substrate;

wherein the heat reduces the viscosity of the adhesive, or decreases adhesion of the adhesive, or both to weaken the adhesive bond between the IED and the substrate; and removing the IED from the substrate without destroying the IED.

3. The method of claim 2 further comprising:

applying an expanding gas between the IED and substrate to force apart the IED and the substrate.

4. The method of claim 3 wherein the gas is contained in a balloon.

5. The method of claim 2 further comprising injecting a hot fluid directly onto or into the adhesive to disrupt the bond between the IED and the substrate.

6. The method of claim 1 wherein the spot heater comprises materials that can withstand power densities in a range of 50,000 to 200,000 W/in, or 100,000 to 150,000 W/in, or about 12,000 W/in.

7. The method of claim 1 wherein the spot heater comprises conductive materials with thermal conductivity less than about 50 W/mK or of sufficiently low thermal mass.

8. The method of claim 7 wherein the spot heater further comprises the conductive materials on a thermally insulating substrate.

9. The method of claim 1 wherein the spot heater comprises carbon nanotubes.

10. The method of claim 2 wherein the spot heater comprises materials that can withstand power densities in a range of 50,000 to 200,000 W/in, or 100,000 to 150,000 W/in, or about 12,000 W/in.

11. The method of claim 2 wherein the spot heater comprises conductive materials with thermal conductivity less than about 50 W/mK or of sufficiently low thermal mass.

12. The method of claim 11 wherein the spot heater further comprises the conductive materials on a thermally insulating substrate.

13. The method of claim 2 wherein the spot heater comprises carbon nanotubes.

14. The method of claim 2 wherein heat from the spot heater reduces viscosity of the adhesive to weaken the adhesive bond between the IED and the substrate.

15. The method of claim 2 wherein heat from the spot heater decreases adhesion of the adhesive to weaken the adhesive bond between the IED and the substrate.

16. The method of claim 2 wherein heat from the spot heater reduces viscosity of the adhesive and reduces adhesion of the adhesive to weaken the adhesive bond between the IED and the substrate.

17. The method of claim 2 wherein a conductive portion of the spot heater is in direct contact with the adhesive layer.

18. The method of claim 3 wherein the expanding gas is a result of decomposition of $H_2O_2$ to $H_2O$ and $O_2$.

19. The method of claim 3 wherein heat from a spot heater initiates a chemical reaction to form the expanding gas via a chemical reaction.

* * * * *